United States Patent [19]

Salvo

[11] Patent Number: 4,672,785

[45] Date of Patent: Jun. 16, 1987

[54] MODIFIED RUNNER AND AREA SEPARATION WALL STRUCTURE UTILIZING RUNNER

[75] Inventor: E. Vincent Salvo, Pleasantville, N.Y.

[73] Assignee: United States Gypsum Company, Chicago, Ill.

[21] Appl. No.: 888,093

[22] Filed: Jul. 17, 1986

Related U.S. Application Data

[63] Continuation of Ser. No. 708,027, Mar. 4, 1985, abandoned.

[51] Int. Cl.[4] ..... E04B 2/84

[52] U.S. Cl. ..... 52/241; 52/735

[58] Field of Search ..... 52/773, 243, 243.1, 52/241, 302, 209, 239, 238.1, 397, 398, 400, 735

[56] References Cited

U.S. PATENT DOCUMENTS

| | | | |
|---|---|---|---|
| 1,975,470 | 10/1934 | McInerney | 52/243.1 |
| 2,038,115 | 4/1936 | Keller | 52/241 |
| 2,105,588 | 1/1938 | Davis | 52/241 |
| 2,275,109 | 3/1942 | McGee | 52/735 |
| 2,322,051 | 6/1943 | Nicholson | 52/242 |
| 2,540,305 | 2/1951 | Tomlinson | 52/242 |
| 2,857,588 | 10/1958 | Koroh | 52/400 |
| 2,904,991 | 9/1959 | Vaughan | 52/242 |
| 3,160,280 | 12/1964 | Burch | 52/241 |
| 3,189,135 | 6/1965 | Slowinski | 52/241 |
| 3,316,624 | 5/1967 | Brudevold | 52/238.1 |
| 3,374,591 | 3/1968 | Tillisch | 52/241 |
| 3,744,199 | 7/1973 | Nauarre | 52/241 |
| 3,788,022 | 1/1974 | Epperlein | 52/241 |
| 3,908,328 | 9/1975 | Nelsson | 52/735 |
| 4,513,557 | 4/1985 | Wendt | 52/242 |

FOREIGN PATENT DOCUMENTS

| | | | |
|---|---|---|---|
| 965217 | 4/1975 | Canada | 52/241 |
| 424468 | 8/1947 | Italy | 52/735 |

*Primary Examiner*—John E. Murtagh

*Attorney, Agent, or Firm*—Samuel Kurlandsky; Robert M. Didrick; Robert H. Robinson

[57] ABSTRACT

An integral generally channel-form runner for securing and supporting one or more wallboard panels in a demountable structure, the runner having an integral support for the lower edges of the wallboard panels in a position spaced above the bottom of the runner to prevent absorption of water and formation of mildew at the edges of the wallboard panels.

5 Claims, 5 Drawing Figures

MODIFIED RUNNER AND AREA SEPARATION WALL STRUCTURE UTILIZING RUNNER

This is a continuation of co-pending application Ser. No. 708,027 filed on Mar. 4, 1985, now abandoned.

BACKGROUND OF THE INVENTION

1. Field of the Invention

The present invention relates to building construction, and more particularly concerns runners to support parallel spaced-apart wallboards in a position wherein their lower edges are spaced above the bottom of the runner to prevent water absorption and mildew.

2. Description of the Prior Art

In the assembly of wall panels to construct a wall, and particularly an area separation wall, it is conventional to provide elongate channel members, called runners for retaining the edges of the panels. The runners are secured to the floor and ceiling, thereby fixing the position of the wall with respect thereto. Such runners may have a variety of shapes, but more generally have a channel-form shape, and invariably require an inner panel supporting surface for each panel. In the construction of area separation walls two rows of wallboard are required. The runners may be manufactured in a variety of ways and form a variety of materials. One of the least expensive fabrication means is to roll-form metal strips into the desired channel shape.

Area separation walls are typically installed prior to complete enclosure of the building. The wallboard panels are therefore exposed to all the common elements. During a rain water collects in the runner track and at low spots on the concrete floor. This water is absorbed at the edges of the gypsum liner panels, eventually causing delamination of the paper and the formation of mildew.

Related structures have been disclosed in patent applications U.S. Ser. Nos.595,626 and 596,029, now U.S. Pat. No. 4,586,305 assigned to the present assignee, United States Gypsum Company. Howver, the structures disclosed in these applications are not as easily fabricated as those of the present structure.

SUMMARY OF THE INVENTION

It is an object of the invention to provide a runner for securing and supporting a wall formed of a plurality of wall panels such as gypsum wallboard panels or other wall panels such as cement board panels.

It is a further object of the invention to provide a runner having an integral platform for supporting the lower edges of panels such as gypsum wallboard panels above the lower portion of the lower runner to prevent the panels from absorbing water and forming mildew.

It is still further an object of the invention to provide a structure of the type described which is inexpensive and relatively easy to fabricate and assemble.

Other objects of the invention will become apparent from reference to the following description and accompanying drawings.

According to the invention, a runner is provided having a supporting structure struck from the web thereof and extending upwardly from the bottom of the runner for supporting the lower edges of gypsum wallboard panels to prevent their being immersed in water which may collect at the bottom of the runner, thereby preventing the deterioration of the paper cover sheets of the panels due to water absorption which may cause mildew.

DESCRIPTION OF THE PREFERRED EMBODIMENTS

Figure 1:
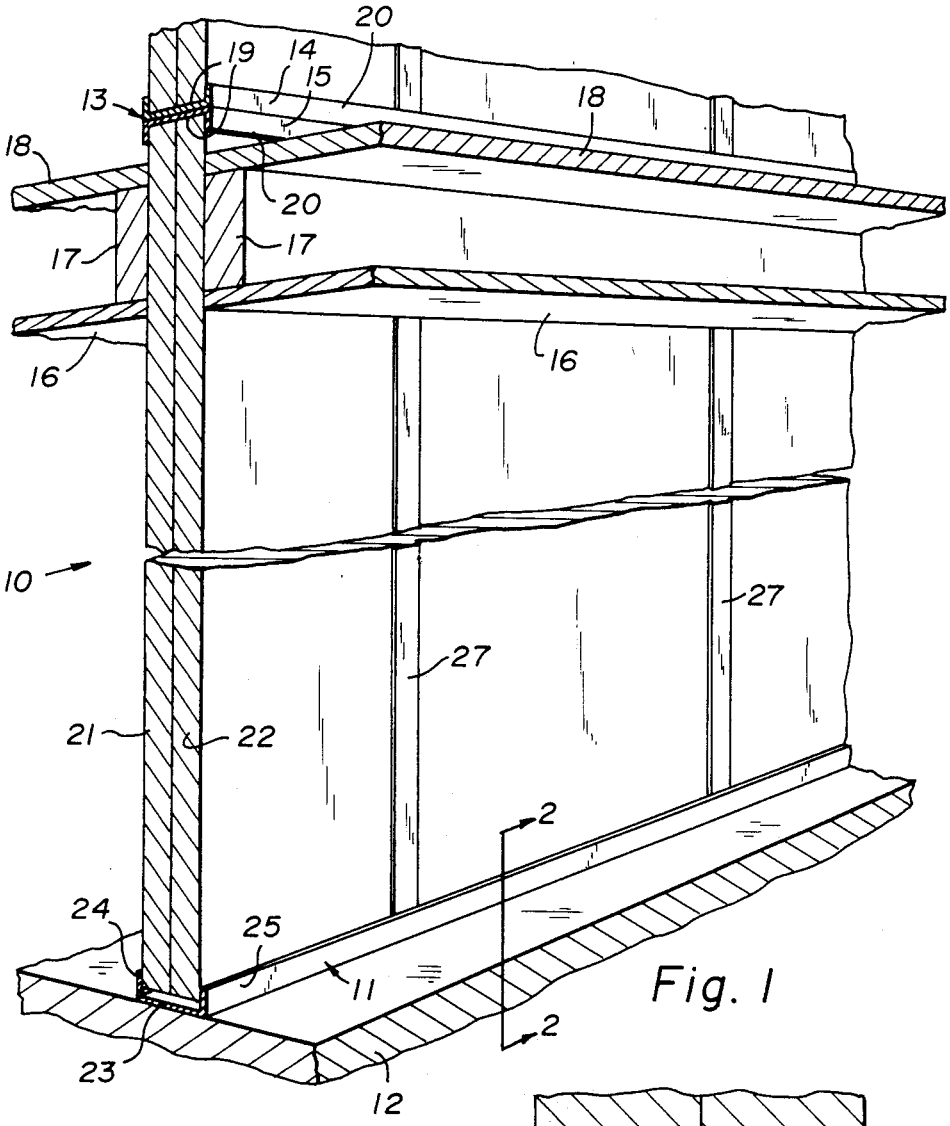
FIG. 1 is a perspective view of an area separation wall according to the invention.

Referring to FIG. 1, an area separation wall structure 10 is shown comprising a lower runner 11 mounted on a floor 12, and an upper runner 13 comprising runner member 14 and 15 mounted back-to-back. A ceiling 16 is mounted on joists 17, and an upper floor 18 is also supported on the joists 17. The upper runner 13 comprises webs 19 and flanges 20. Gypsum wallboard panels 21 and 22 are supported by the lower runner 11 with their edges spaced above the web 23 of the runner 11.

Figure 2:
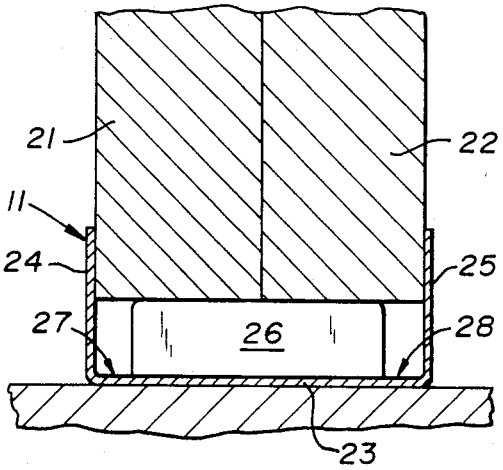
FIG. 2 is a perspective view of a runner having one embodiment of the supporting structure.
Figure 3:
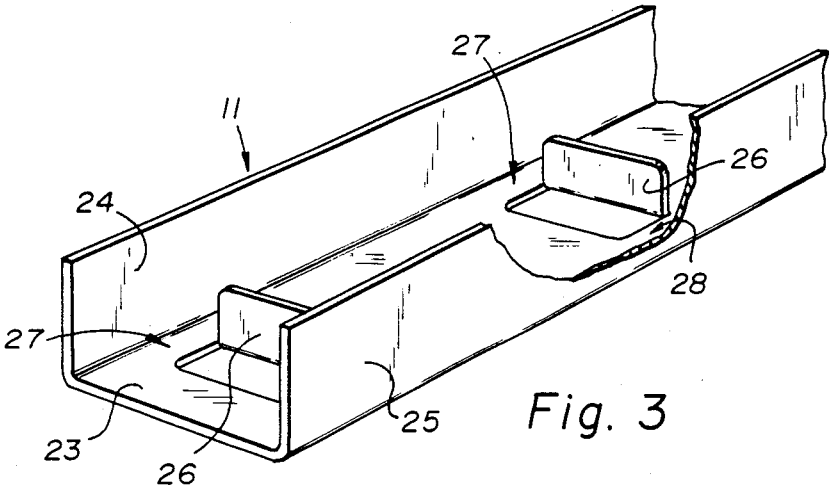
FIG. 3 is a perspective view of another embodiment of the invention.

Referring to FIGS. 2 and 3, a lower runner structure 11 according to one embodiment of the present invention is illustrated, and comprises a web 23 having longitudinal flanges 24 and 25 extending therefrom. A transverse upstanding tab 26 is struck from the web 23 at a plurality of locations and supports the lower edges of the gypsum wallboard 21 and 22 spaced-apart from the web 23 of the runners 11. Lateral bridges 27 and 28 are provided to permit space for the placement of H-studs if desired.

Figure 4:
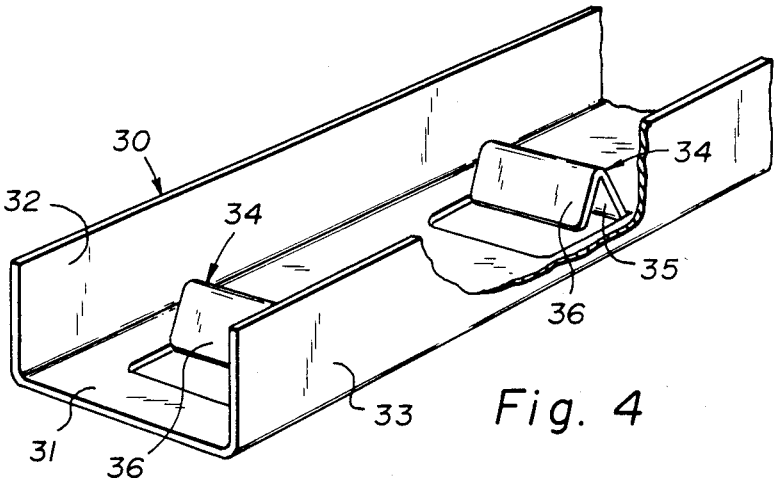
FIG. 4 is a perspective view of still another embodiment of the invention.

Referring to FIG. 4, a lower runner 30 comprising another embodiment of the invention is shown, and comprises a web 31 having longitudinal flanges 32 and 33. A plurality of transverse upstanding tabs 34 are struck from the web 31 and, each comprising a proximal tab member 35 and a distal member 36. This embodiment has the advantage that the portion of the tab supporting the edges of the gypsum wallboard are not sharp.

Figure 5:
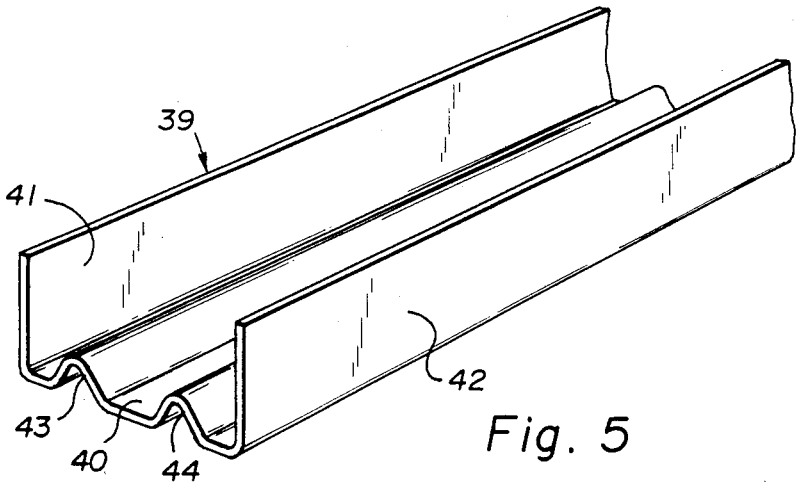

Referring to FIG. 5, a runner 39 which constitutes still another embodiment of the invention is shown, and comprises a web 40 having longitudinal flanges 41 and 42. Here support for the edges of the gypsum wallboard comprise a pair of inverted-V ridges 43 and 44 formed or struck up from the web 40. In this embodiment, also, the location supporting the edges of the gypsum wallboard panels are not sharp.

In assembling the area separation wall 10 of the present invention, the lower runners 11, 30, or 39 are first affixed to the floor. Gypsum wallboard panels 21 and 22 are then set into the channels of the runners and are supported by the transverse tabs 26 or 34, or by the inverted-V ridges 43 and 44, with the edges of the wallboard panels spaced above the webs 23, 31 or 40. The vertical edges of the wallboard panels are retained by studs 27. The upper runner 13 is mounted over the upper edges of the gypsum wallboard panels 21 and 22.

During the construction of a building, when the outer walls have not been completely finished, water tends to get into the interior of the building. Some water generally passes into the channels of the runners. If the edges of the gypsum wallboard panels rest in the water, water is absorbed in the paper cover sheets, leading to deterioration and mildew formation. However, in the present invention, since the edges of the wallboard panels are maintained at a distance above the web of the runners by the structure of the present invention, water does not come into contact with the panels, and consequently does not seep into the panels, thereby avoiding the condition where the above-stated problem could occur.

The structure of the present invention offers a number of advantages. First, the structure is integral with the webs of the runners and consequently do not add any material expense. The elevated or upstanding web structures maintain the panels spaced above the bottom of the runner and consequently keep the panel edges out of contact with any water which may collect in the channel of the runner. The runners are very inexpensive and easy to fabric.

While the present invention has been disclosed and described and shown in the light of the specific embodiments thereof, it is evident that many alternatives, modifications, and variations may be readily apparent to one skilled in the art in the light of the foregoing disclosure as contained in the specification and drawings. Accordingly, the disclosure is intended to embrace all such alternatives, modifications and variations as may fall within the spirit and scope of the invention as defined in the following appended claims.

Invention is claimed as follows:

1. An integral substantially U-shaped runner for supporting a pair of panels in face-to-face engagement positioned therein, comprising:

(a) a web, (b) a pair of flanges extending perpendicularly one from each edge of said web and defining a channel therewith, (c) portions of said web being struck therefrom to provide rigid tabs displaced inwardly into said channel transversely to the longitudinal direction thereof, said inwardly displaced tabs struck from said web each comprising an upwardly directed tab member and a downwardly directed tab member connected together at a crease and being mutually integral, said tab members cooperating to define inverted-V shaped tabs, the crease connecting said tab members adapted rigidly to support the lower edges of said wallboard panels, whereby, when said panels are inserted into said runner, the creases connecting said tab members rigidly support the lower edges of both said panels elevated at a distance above said web sufficient to prevent water which may be present in said channel from contacting the edges of said panels.

2. A wall structure comprising in combination: an integral substantially U-shaped runner comprising:

(a) a web, (b) a pair of flanges extending perpendicularly one from each edge of said web and defining a channel therewith, (c) portions of said web being struck inwardly into said channel to provide rigid tabs transversely oriented with respect to the longitudinal direction thereof, and (d) a pair of wallboard panels arranged in face-to-face engagement having their lower edges disposed in said channel and supported by the edges of said tabs at an elevation above the web of said runner sufficient to prevent water which may be present in said channel from contacting the edges of said panels.

3. A wall structure according to claim 2, wherein said inwardly displaced tabs struck from said web are substantially perpendicular thereto.

4. A wall structure according to claim 2, wherein the edges of said tabs are spaced apart from said flanges to permit a structure to be inserted therebetween.

5. A wall structure according to claim 2, wherein said inwardly displaced tabs struck from said web each comprise an upwardly directed tab member and a downwardly directed tab member integral therewith, said tab members cooperating to define inverted-V shaped tabs, the crease connecting said tab members adapted rigidly to support the lower edge of said wallboard panel.

* * * * *